US008041253B2

(12) United States Patent
Carter et al.

(10) Patent No.: US 8,041,253 B2
(45) Date of Patent: Oct. 18, 2011

(54) SYSTEMS AND METHODS TO CONTROL ACCESS TO AN INTERIOR OF AN IMAGE FORMING DEVICE

(75) Inventors: Daniel L. Carter, Georgetown, KY (US); Larry Steven Foster, Lexington, KY (US); Edward Lynn Triplett, Lexington, KY (US); Brian Reed Spencer, Lexington, KY (US); David Erwin Rennick, Georgetown, KY (US); Gary Michael Tylicki, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 881 days.

(21) Appl. No.: 11/964,388

(22) Filed: Dec. 26, 2007

(65) Prior Publication Data

US 2009/0169244 A1 Jul. 2, 2009

(51) Int. Cl.
*G03G 15/00* (2006.01)

(52) U.S. Cl. ..... 399/110; 399/125

(58) Field of Classification Search ..... 399/107, 399/110; 74/422

See application file for complete search history.

(56) References Cited

U.S. PATENT DOCUMENTS

| | | | | |
|---|---|---|---|---|
| 7,130,562 | B2 | 10/2006 | Foster et al. | |
| 7,252,618 | B2 | 8/2007 | Spakowski et al. | |
| 2006/0081077 | A1* | 4/2006 | Spakowski et al. | 74/89.18 |
| 2006/0177237 | A1* | 8/2006 | Kim et al. | 399/107 |
| 2007/0116506 | A1 | 5/2007 | Portig et al. | |

FOREIGN PATENT DOCUMENTS

| | | | |
|---|---|---|---|
| JP | 61-185935 | | 8/1986 |
| JP | 61185935 | A * | 8/1986 |

* cited by examiner

*Primary Examiner* — David Gray
*Assistant Examiner* — Billy J Lactaoen
(74) *Attorney, Agent, or Firm* — Coats & Bennett

(57) ABSTRACT

The present application is directed to systems and methods to control access to an interior of an image forming device. The image forming device may include a body with a door that is movable between open and closed positions. In the open position, access is gained to an interior of the body. A controller controls a latch through a motor arrangement to lock and unlock the door. A user interface may be positioned on an exterior of the body to allow a user to enter commands to lock and unlock the door. Additional elements may also be included within the interior of the image forming device and operated with the motor arrangement.

16 Claims, 15 Drawing Sheets

SYSTEMS AND METHODS TO CONTROL ACCESS TO AN INTERIOR OF AN IMAGE FORMING DEVICE

BACKGROUND

The present application is directed controls for operating an image forming device and, more specifically to assemblies for a latch to control access to an interior of the image forming device.

Image forming devices, such as but not limited to printers, copiers, and facsimile machines, include one or more imaging units. The imaging units may include toner, developer rollers, photoconductive rollers, and others that are necessary for image formation. The imaging units are removable and can be replaced as necessary, such as when the toner is depleted. Therefore, it is necessary that the image forming devices be constructed to allow access to the imaging units for removal and replacement.

Access to the imaging units is beneficial for users during replacement but may also allow access to nefarious individuals intent on stealing the imaging units. Therefore, it may be necessary to secure the image forming device in a manner that prevents this type of theft.

Accessing the imaging units while the image forming device is operating may result in a media jam or poor image formation. Therefore, it may also be necessary to limit access to the imaging units to times when the image forming device is not operating.

SUMMARY

The present application is directed to systems and methods to control access to an interior of an image forming device. The image forming device may include a body with a door that is movable between open and closed positions. In the open position, access is gained to an interior of the body. A controller controls a latch through a motor arrangement to lock and unlock the door. A user interface may be positioned on an exterior of the body to allow a user to enter commands to lock and unlock the door. Additional elements may also be included within the interior of the image forming device and operated with the motor arrangement.

DETAILED DESCRIPTION

The present application discloses various embodiments for controlling access to an interior of an image forming device. The embodiments include a motor arrangement to control a latch. The motor arrangement may control a coupling between the image forming device and imaging units. The motor arrangement provides for an improved user interface and secures elements within the interior of the image forming device.

Figure 1:
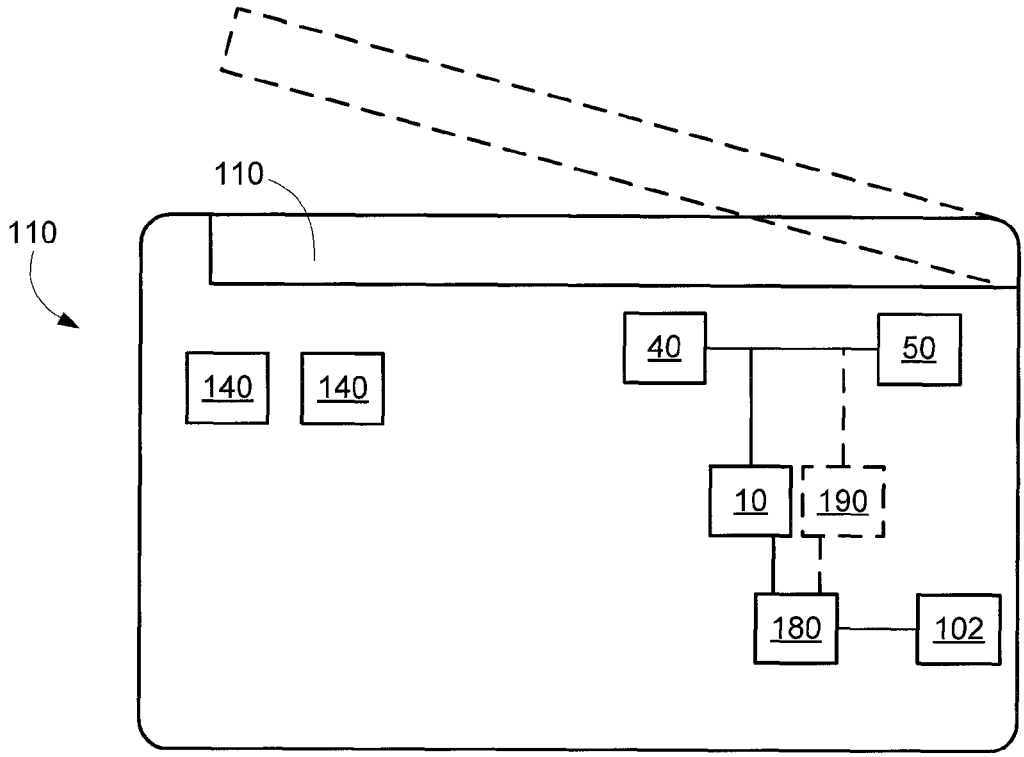
FIG. 1 is a schematic view of an image forming device with a controller that controls a motor arrangement according to one embodiment.

FIG. 1 illustrates a schematic representation of an image forming device 100 that includes a door assembly 110. The door assembly 110 may be moved between a closed position as illustrated in solid lines, and an open position as illustrated in dashed lines. One or more image forming units 140 are accessible when the door assembly 110 is in the open position. A controller 180 controls a motor assembly 10 that moves the latches 50 between locked and unlocked positions. The motor assembly 10 may also control other functions within the image forming device 100, including a retraction assembly 40 that engages with the one or more image forming units 140. A control panel 102 provides a mechanism for a user to input commands to the controller 180 to unlock the latches 50 and provide access to an interior of the image forming device 100.

Figure 12:
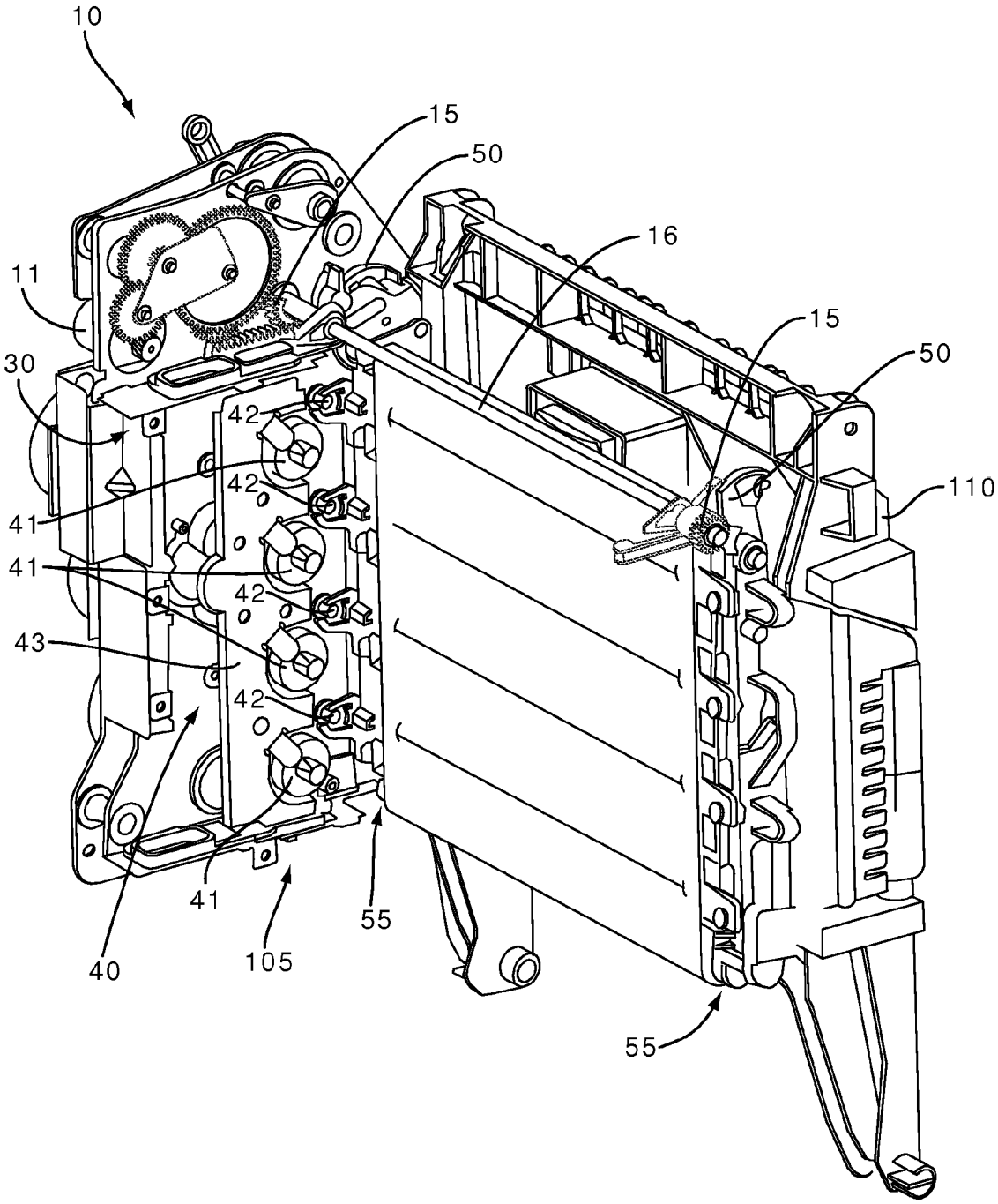
FIG. 12 is a perspective view of a motor arrangement positioned within an interior of an image forming device according to one embodiment.

FIG. 12 illustrates one embodiment of the motor arrangement 10 that includes a motor 11 and is positioned within an interior 105 of an image forming device. The motor arrangement 10 controls the retraction assembly 40 that includes first and second couplings 41, 42. The motor arrangement 10 also controls one or more latches 50 to lock the first door assembly 110 in the closed position. The motor arrangement 10 prevents access to the interior of the image forming device while it is running to prevent inadvertent media jams. The motor arrangement 10 also provides a security measure to lock access to the interior and prevent theft of any of the components, such as the imaging units 140 (See FIG. 1).

A context of the workings of the controller 180 and motor arrangement 10 is best understood within a context of exemplary image forming devices 100, retraction assemblies 40, latches 50, and first door assemblies 110. Each will be explained, followed by the specific details of the motor arrangement 10.

Figure 2A:
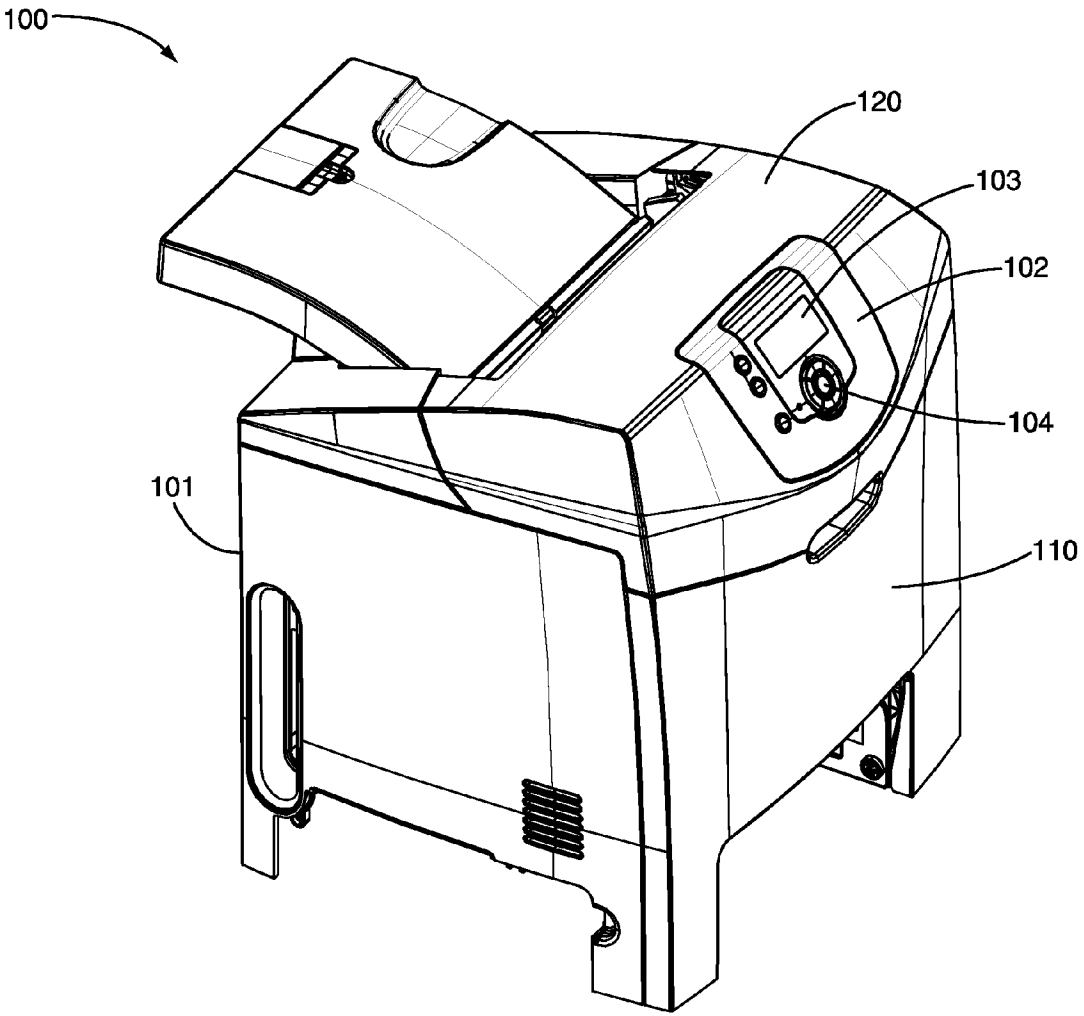
FIG. 2A is a perspective view of an image forming device with both first and second door assemblies in closed positions according to one embodiment.
Figure 2B:
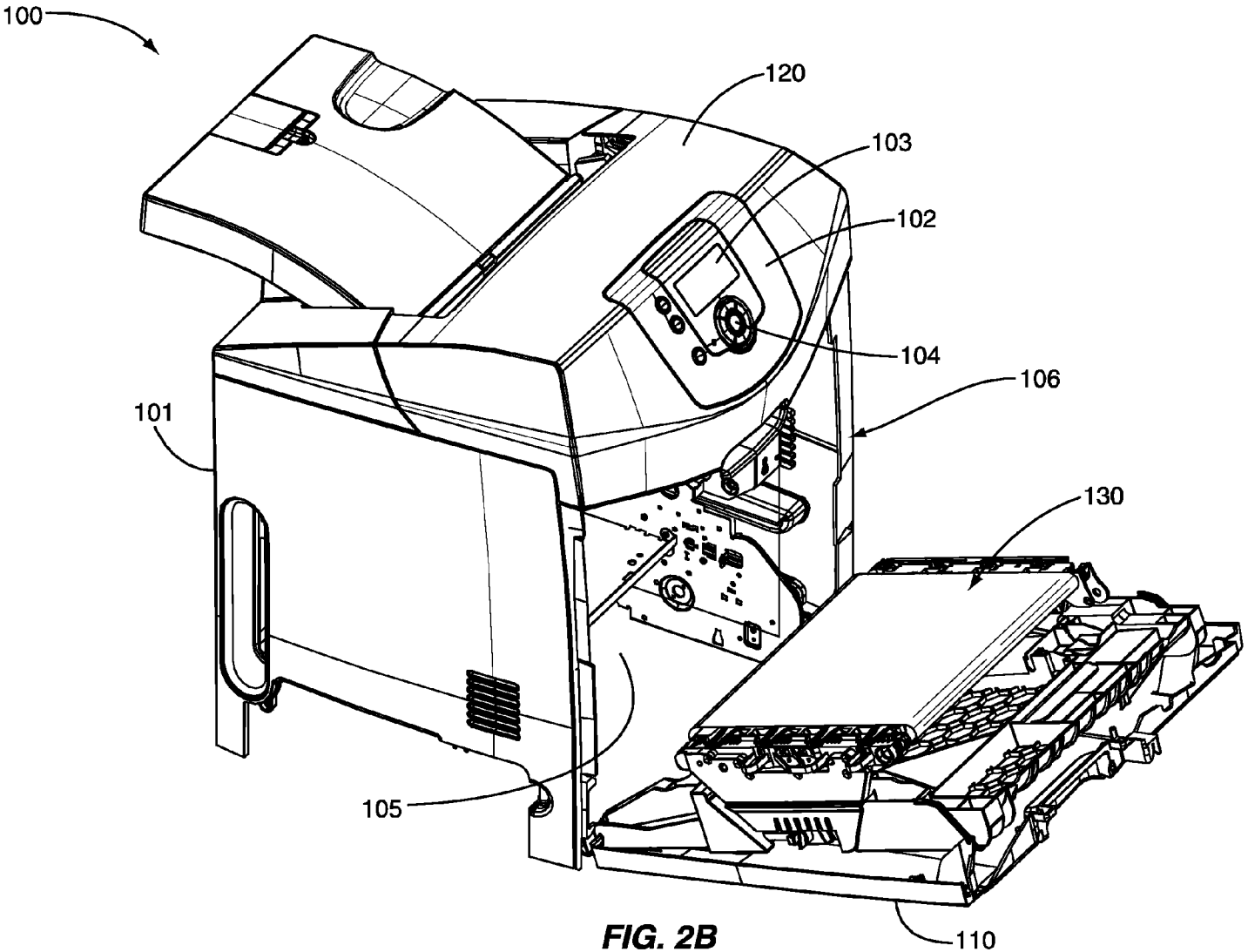
FIG. 2B is a perspective view of an image forming device with a first door assembly in an open position and a second door assembly in a closed position according to one embodiment.
Figure 2C:
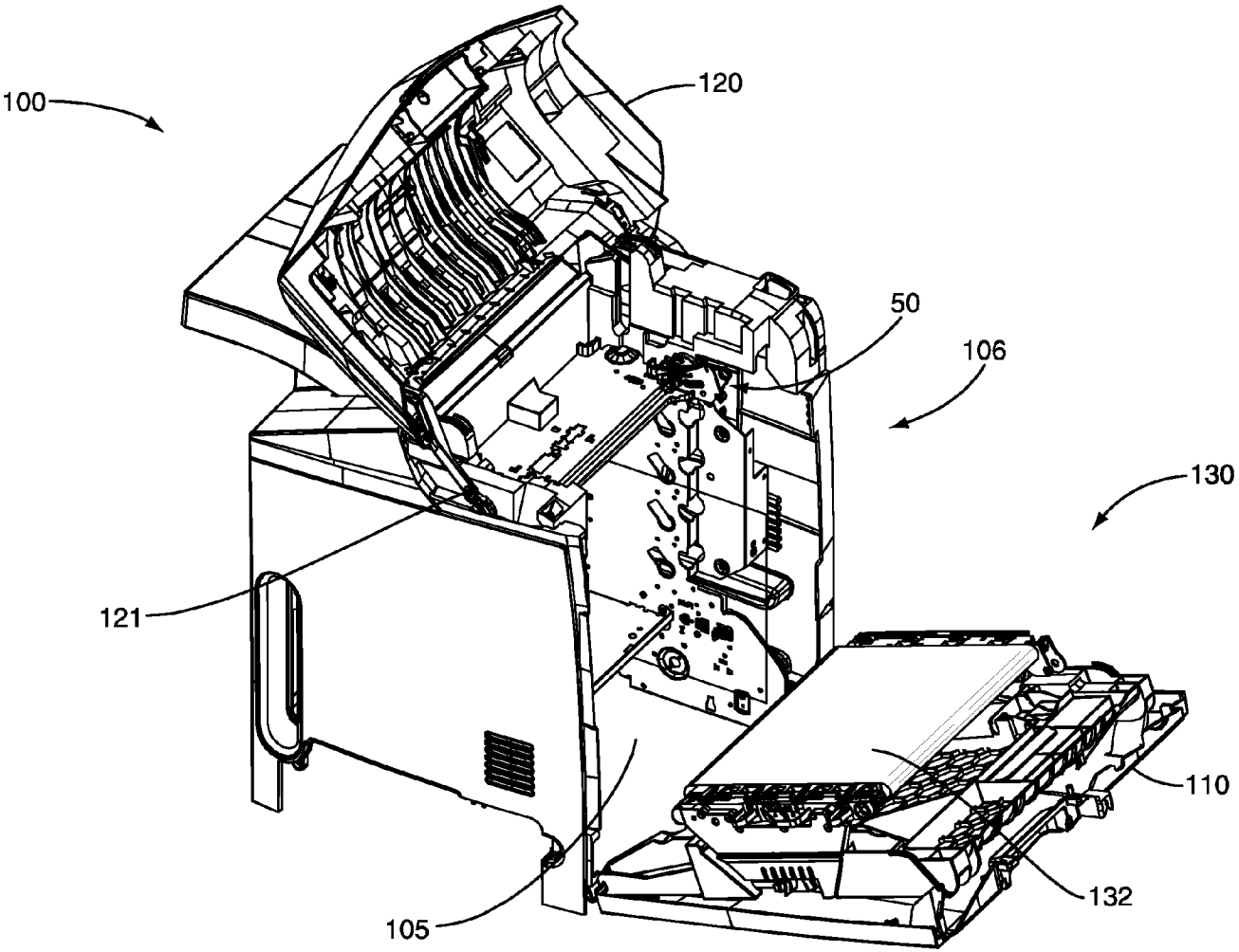
FIG. 2C perspective view of an image forming device with both first and second door assemblies in open positions according to one embodiment.

FIGS. 2A-2C illustrate the image forming device 100 in various stages. The exemplary image forming device 100 comprises a main body 101, a first door assembly 110, and a second door assembly 120. As used herein, the term "door assembly" is intended to refer to a door panel that is movably or detachably coupled to the main body 101. Exemplary door assemblies 110, 120 may simply comprise a door panel and any mounting hardware that permits relative movement between the main body 101, including but not limited to hinges and link arms or pivot arms. As indicated below, other components may be coupled to the door assemblies 110, 120. The first door assembly 110 is located towards a lateral side of the body 101, and the second door assembly 120 is located towards a top side of the body 101. In the exemplary image forming device 10, the user interface 102 comprising a display 103 and one or more input buttons 104 is disposed on the second door assembly 120.

Each door assembly 110, 120 is movable between closed and open positions. In the exemplary embodiment, the door assemblies 110, 120 are opened in the order illustrated by the progression from FIG. 2A to FIG. 2B to FIG. 2C. That is, the first door assembly 110 is initially opened as illustrated in FIG. 2B, followed by the second door assembly 120. In one embodiment, access to the interior 105 of the image forming device 100 may be completed through the first door assembly 110, with the second door assembly 120 used for a limited number of operations. The first door assembly 110 may overlap the second door assembly 120 thereby preventing the second door assembly 120 from being moved to the open position prior to the first door assembly 110.

One or more modules may be coupled to the first and second door assemblies 110, 120. For instance, FIG. 2C shows a belt module 130 coupled to the first door assembly 110. The belt module 130 may be an image transfer belt, a document transport belt, or other belt commonly used in image forming devices.

Figure 3:
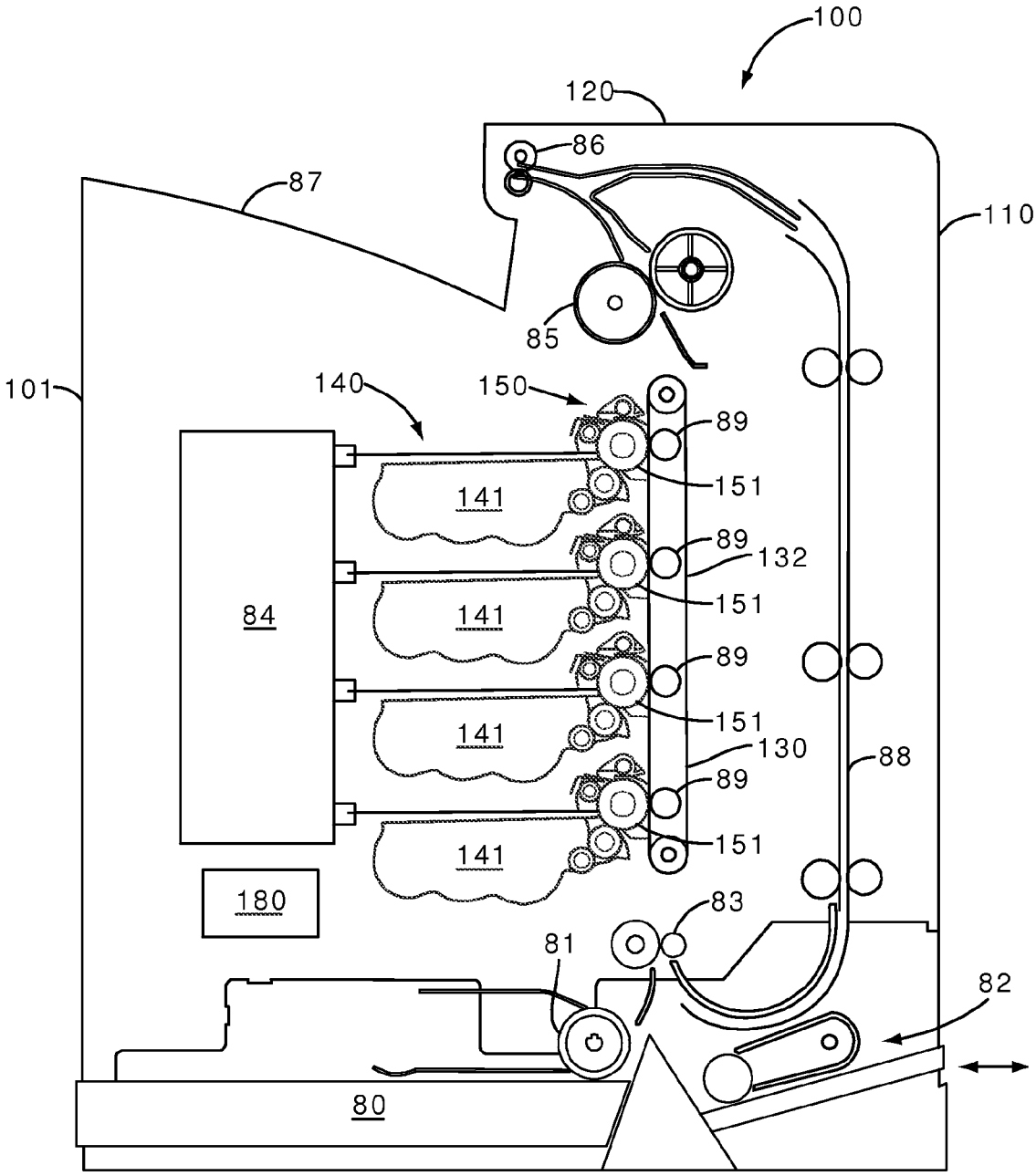
FIG. 3 is a schematic side view of an image forming device according to one embodiment.

A schematic representation of the exemplary image forming device 100 is shown in FIG. 3. The image forming device 100 includes a media tray 80 with a pick mechanism 81 and a multi-purpose feeder 82, both of which are conduits for introducing media sheets into the device 100. The media tray 80 is preferably removable for refilling, and located on a lower section of the device 100. Media sheets are moved from the input and fed into a primary media path. One or more registration rollers 83 disposed along the media path aligns the print media and precisely controls its further movement along the media path. The belt module 130 forms a section of the media path for moving the media sheets past a plurality of image forming units 140. Each image forming unit 140 includes a developer unit 141 and a photoconductive unit 150. Color printers typically include four image forming units 140 for printing with cyan, magenta, yellow, and black toner to produce a four-color image on the media sheet.

An optical scanning device 84 forms a latent image on photoconductive members 151 within the image forming units 140. In one embodiment, each of the image forming units 140 is substantially identical except for their color of toner. Toner from developer units 141 is supplied to develop the respective latent images. The developed images are then transferred from the photoconductive members 151 to the media sheet being transported by the belt module 130. The media sheet with loose toner is then moved through a fuser 85 that adheres the toner to the media sheet. Exit rollers 86 rotate in a forward direction to move the media sheet to an output tray 87. Optionally, the rollers 86 may rotate in a reverse direction to move the media sheet to a duplex path 88. The duplex path 88 directs the inverted media sheet back through the image formation process for forming an image on a second side of the media sheet.

Figure 4:
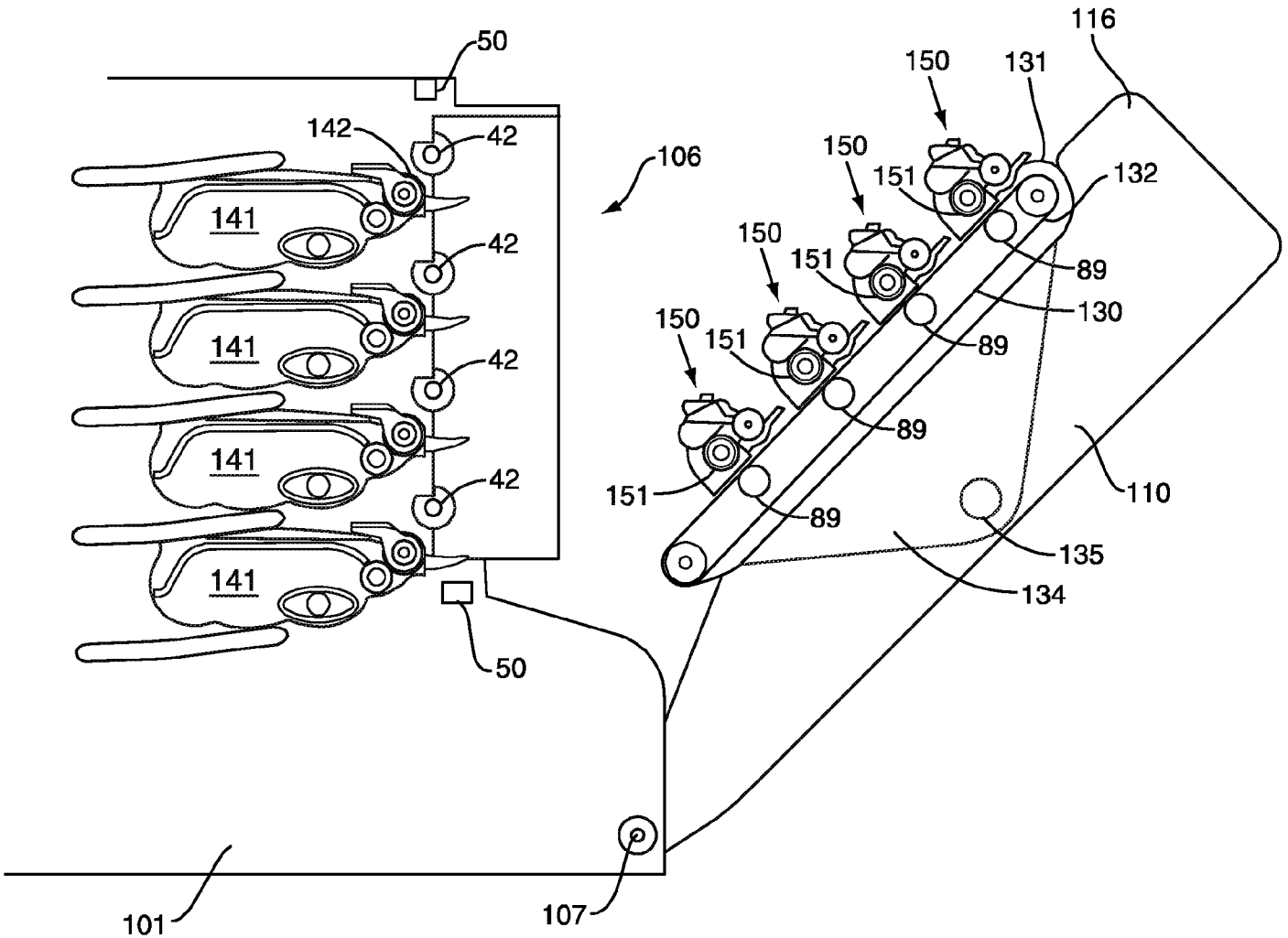
FIG. 4 is a schematic side view of a first door assembly in an open position according to one embodiment.

As indicated above, at least one internal module may be attached to the first door assembly 110 and travel with the first door assembly 110 as it moves between open and closed positions. FIG. 2C shows at least a belt module 130 being coupled to the first door assembly 110. Other modules may be coupled to the first door assembly 110 as well. For example, some portion or the entire image forming unit 140 may be coupled to the first door assembly 110. FIG. 4 illustrates an exemplary image forming unit 140 constructed of a separate developer unit 141 and a photoconductor unit 150. The developer unit 141, including a developer member 142, may be positioned within the main body 101 whereas the photoconductor unit 150, including a photoconductive member 151, may be mounted to the first door assembly 110 along with the aforementioned belt module 130.

With the first door assembly 110 in a closed position as illustrated in FIGS. 2A and 3, the first door assembly 110 is positioned adjacent to the main body 101 with the photoconductive member 151 of the photoconductor unit 150 positioned adjacent the developer unit 141. In an open position as illustrated in FIGS. 2B, 2C and 4, the first door assembly 110 is moved away from the main body 101 separating the photoconductor units 150 from the developer units 141. This configuration provides direct and easy user access to the developer units 141, photoconductor units 150, and the belt module 130.

As illustrated in FIGS. 2B, 2C and 4, the main body 101 has enclosed sides forming an opening 106 leading into the interior 105 for mounting the developer units 141. Developer units 141 are positioned within the interior 105 with the developer rollers 142 extending to contact the photoconductive members 151 during image formation. The opening 106 may be sized to encompass the entire side of the main body 101, or may comprise only a limited portion of one side. In the embodiment of FIG. 4, the opening 106 is positioned on a lateral side of the main body 101. Opening 106 may also be positioned on the top or bottom side of the main body 101 depending upon the application. For instance, in image forming devices that orient the image forming units 140 in a more horizontal configuration, the opening 106 may be advantageously placed towards a top side of the main body 101.

The first door assembly 110 is movably attached relative to the main body 101 between an open position as illustrated in FIGS. 2B, 2C and 4 and a closed position as illustrated in FIGS. 2A and 3. The first door assembly 110 may be attached to the main body 101 in a variety of manners. FIG. 4 illustrates one embodiment with the first door assembly 110 pivotally attached to the main body 101 through a pivot 107. Pivot 107 may attach the main body 101 and first door assembly 110 at a variety of locations. In the open position, a door assembly upper edge 116 is spaced from the main body 101. This position provides access to the developer units 141, photoconductor units 150, and media path, including the belt module 130. In the closed position, the upper edge 116 is in proximity to the main body 101. The upper edge 116 may be in contact with the main body 101, or slightly spaced apart from the main body 101.

The second door assembly 120 extends over a top section of the main body 101. The second door assembly 120 moves about pivots 121 between a closed position as illustrated in FIGS. 2A and 2B, and an open position as illustrated in FIG. 2C. In one embodiment, the second door assembly 120 is overlapped by the first door assembly 110. Therefore, the second door assembly 120 cannot be moved from the closed to the open position without the first door assembly 110 already being in the open position. In one embodiment, full access to the interior 105 is obtained through the first door assembly 110 when the second door assembly 120 is in the closed position. The second door assembly 120 may be moved to the open position for selective operations, including replacing or accessing the fuser 85.

FIG. 4 illustrates the photoconductor units 150 coupled to the first door assembly 110. A roller frame 131 is coupled to the first door assembly 110 and configured so that transfer rollers 89 substantially span the width of belt module 130. An endless belt 132 extends around the rollers 89. The roller frame 131 is attached to a subframe 134 that is pivotally attached to the first door assembly 110 at a pivot 135. The pivot 135 allows the subframe 134 to move relative to the first door assembly 110 when the first door assembly 110 is in the open position. In the closed position, the roller frame 131 and subframe 134 are accurately aligned with the main body 101 such that the photoconductive members 151 are aligned with the developer rolls 142.

Figure 5A:
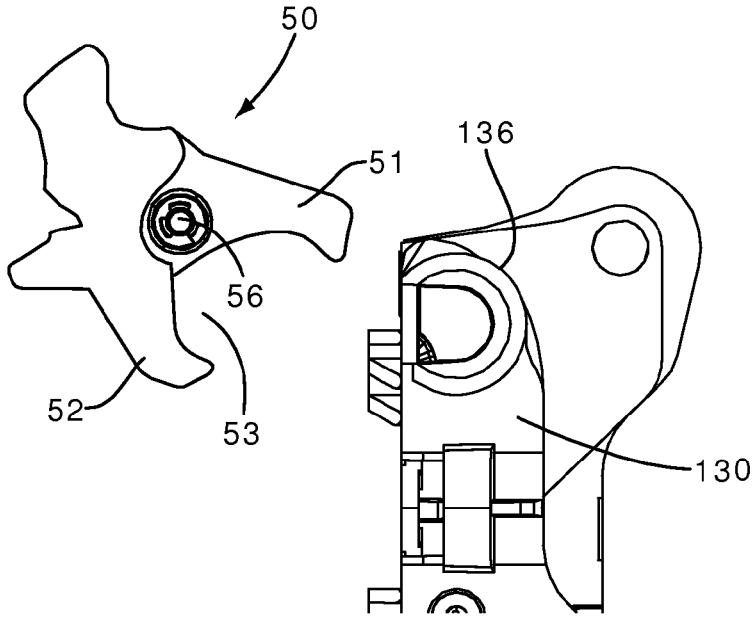
FIG. 5A is a side schematic view of a latch in an unlocked position according to one embodiment.

One or more latches 50 maintain the first door assembly 110 in the closed position and secure the roller frame 131 and subframe 134 in this aligned position. The latches 50 are attached to the main body 101 in proximity to the opening 106 to engage with the first door assembly 110. FIG. 5A illustrates one embodiment of the latch 50 that includes a first arm 51 and second arm 52 spaced apart to form an gap 53. The gap 53 is sized to receive a protrusion 136 on the roller frame 131.

Figure 5B:
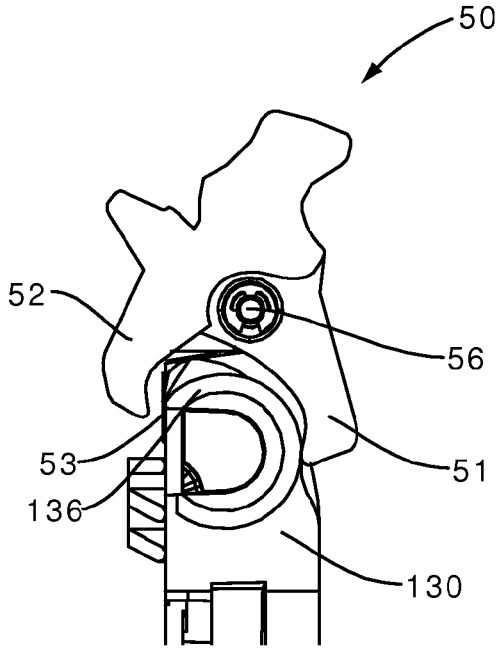
FIG. 5B is a side schematic view of a latch in a locked position according to one embodiment.

The latch 50 is rotatable about a point 56. The latch 50 is in an unlocked position such that the opening 53 faces outward away from the main body 101 and towards the first door assembly 110 when the first door assembly 110 is in the open position as illustrated in FIG. 5A. The first door assembly 110 is moved towards a closed position such that the protrusion 136 is positioned within the opening 53. The motor arrangement 10 is then activated to rotate the latch 50 about the point 56 to a locked position as illustrated in FIG. 5B. This positioning maintains the first door assembly 110 in the closed position and allows for image formation. In one embodiment, movement of the latch 50 from the unlocked position to the locked position causes lateral movement of the first door assembly 110.

Figure 6:
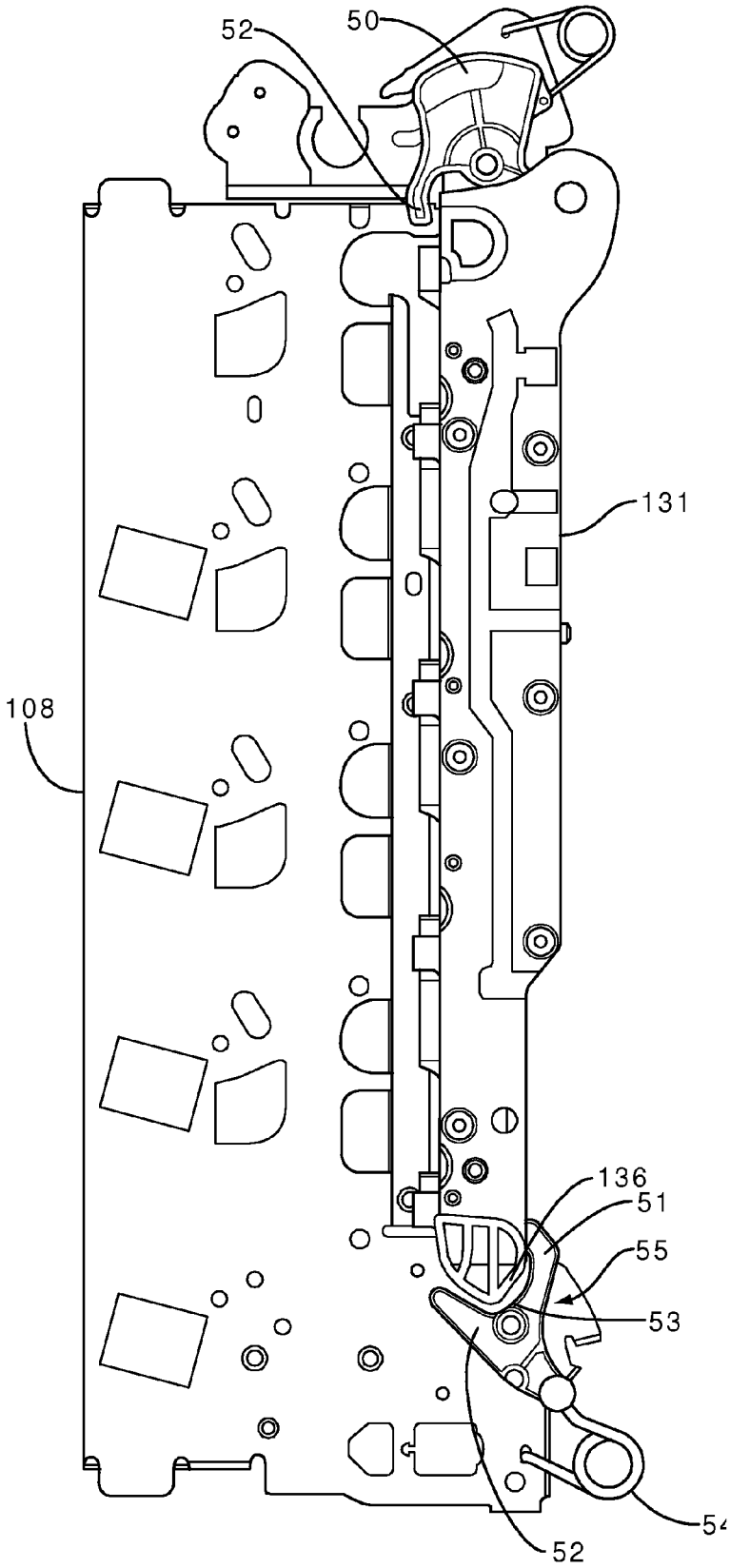
FIG. 6 is a side schematic view of a roller frame in a closed position and an interior frame according to one embodiment.

FIG. 6 illustrates a more detailed representation of the roller frame 131 secured to an interior frame 108 disposed within the main body 101 by at least one latch 50. The remaining portions of the image forming device 100, including the image forming units 140, and first door assembly 110 are omitted from FIG. 4 for clarity. The roller frame 131 is depicted in the closed position in FIG. 6. The latch 50 is depicted in a locked position, thereby securing the roller frame 131 in the closed position.

Various numbers of latches 50 may be used for securing the first door assembly 110 in the closed position. In one embodiment, four latches 50 are used with one in each corner of the opening 106 (i.e., top right position, top left position, bottom right position, bottom left position).

In addition to motorized latches 50, biased latches 55 may also be used to interact with the first door assembly 110. The biased latches 55 include a biasing member 54 attached in an over-center orientation as illustrated with the lower latch 50 of FIG. 6. When the user moves the first door assembly 110 towards the closed position, the protrusion 136 contacts and pivots the latch 50 towards the locked position. After the protrusion 136 moves a specific amount, the over-center positioning of the biasing member 54 then biases the latch 50 towards the locked position.

In one embodiment, the image forming device 100 includes at least one motorized latch 50 and at least one biased latch 55. The motorized latch 50 locks the latch 50 in the locked position and prevents moving the first door assembly 110 to the open position. The biased latch 55 only maintains the first door assembly 110 in the closed position by the force applied by the biasing member 54. A person can overcome the force of the biasing member 54 and move the door to the open position. The biased latch 55 may position the first door assembly 110 in the closed position until it can be fully locked by the motorized latch 50. FIG. 12 includes an embodiment with the two upper latches 50 being motorized and controlled by the motor arrangement 10. The two lower latches 55 are biased by biasing members 54.

One embodiment of a first door assembly and latches is disclosed in U.S. patent application Ser. No. 11/286,671 filed on Nov. 23, 2005, and herein incorporated by reference.

The motor arrangement 10 also controls the retraction assembly 40 that powers the imaging units 140. The retraction assembly 40 retracts and extends the first developer unit coupling 41 and second photoconductive unit coupling 42 upon movement of the first door assembly 110 relative to the main body 101. Prior to moving the first door assembly 110 from the closed position to the open position, the photoconductor units 150 of the imaging unit 140 should first be decoupled from the drive couplings 42. Additionally, to remove or insert a developer unit 141 from or into the main body 101, at least the developer unit 141 of interest must be decoupled from the coupling 41 that supplies rotary power to it.

Preferably, all of the drive mechanism couplings 41, 42 to all developer units 141 and photoconductor units 150 should be decoupled, or retracted, simultaneously, allowing any imaging unit 140 to be removed and/or replaced without the necessity of individually retracting its drive mechanism coupling. More preferably, the drive mechanism couplings 41, 42 should be automatically retracted from the imaging units 140 whenever the first door assembly 110 is opened to allow access to the imaging units 140, without requiring conscious action on the part of the user. According to various embodiments, the drive couplings 41, 42 supplying rotary power to the developer units 141 and the photoconductor units 151 are retracted simultaneously, by actuation of a retraction plate 43 within a coupling retraction mechanism 20, 30, as described herein.

Figure 7:
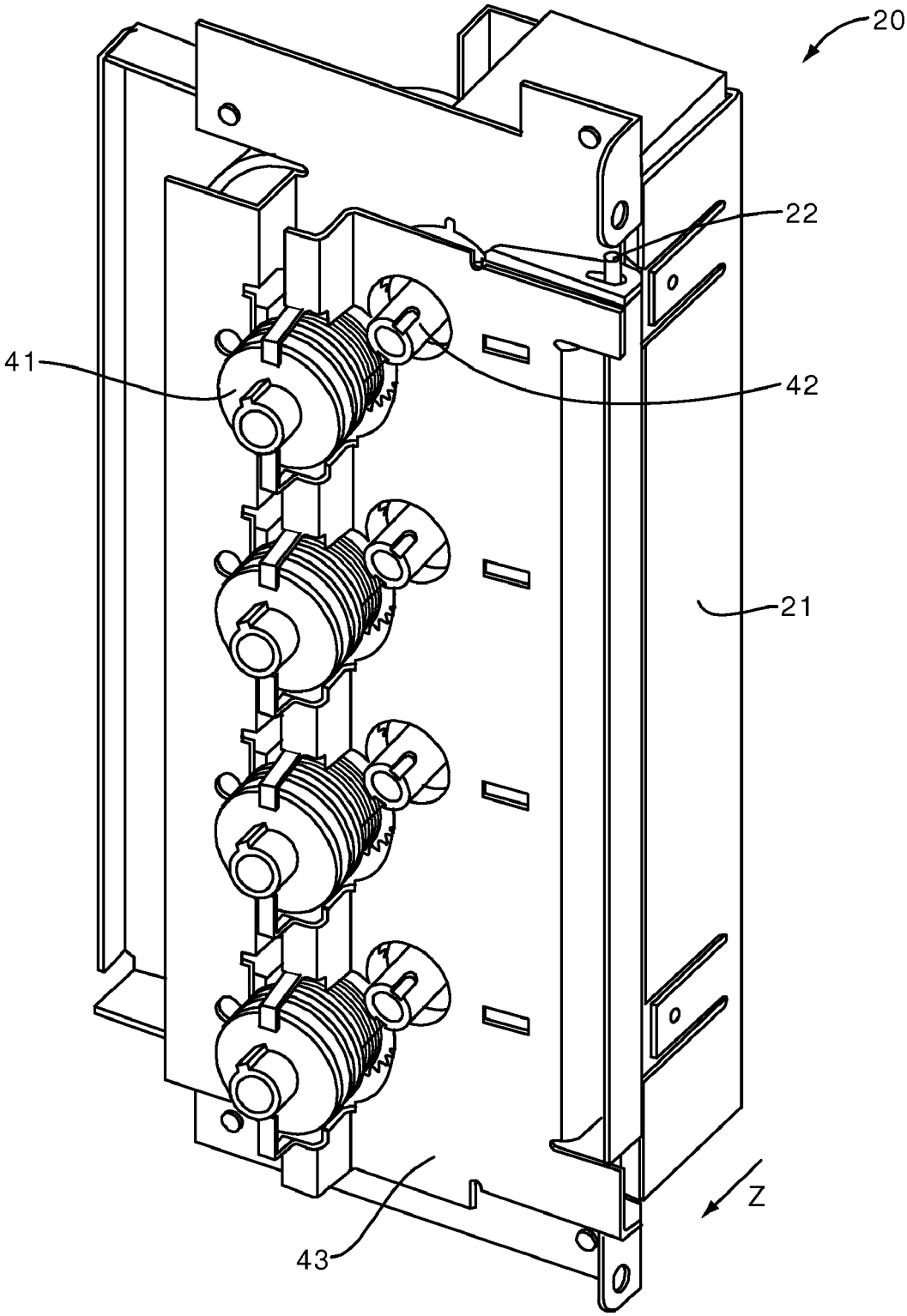
FIG. 7 is a perspective view of a retraction mechanism according to one embodiment.

In particular, a pivoting coupling retraction mechanism according to one embodiment of the present invention is depicted in FIG. 7, indicated generally by element number 20. The pivoting coupling retraction mechanism 20 comprises a gearbox frame 21 housing various drive components such as motors, gears, and the like, and a pivoting retraction plate 43. Mounted to gearbox frame 21, and axially retained by the pivoting retraction plate 43, is a plurality of developer unit couplings 41, which mate with and provide rotational power to a corresponding plurality of developer units 141. In this embodiment, the developer unit couplings 41 comprise Oldham couplings, which are capable of transferring rotary power between two parallel, but not necessarily radially aligned, shafts. Additionally mounted to gearbox frame 21, and axially retained by the pivoting retraction plate 43, is a plurality of photoconductor unit couplings 42, each of which couples with and provides rotary power to a corresponding photoconductor unit 150.

The developer unit couplings 41 and photoconductor unit couplings 42 are biased in the positive z-direction (out of the page as depicted in FIG. 7), such as by biasing members. The couplings 41, 42 mate with their respective input members on the removable image forming units 140 when the pivoting retraction plate 43 is in an engaged position, and are constrained in the positive z-direction by the pivoting retraction plate 43 when it is in a retracted position. According to the present invention, the developer unit couplings 41 and photoconductor unit couplings 42 (four of each in the embodiment depicted in FIG. 7) are simultaneously retracted in the negative z-direction (i.e., in an axial direction of the coupling shafts) as the pivoting retraction plate 43 moves from an engaged to a retracted position.

In the embodiment depicted in FIG. 7, the pivoting retraction plate 43 moves from an engaged to a retracted position by pivoting about a pivot rod 22. Preferably, the pivoting retraction plate 43 pivots through an angle between about 5° and 10°.

Figure 8A:
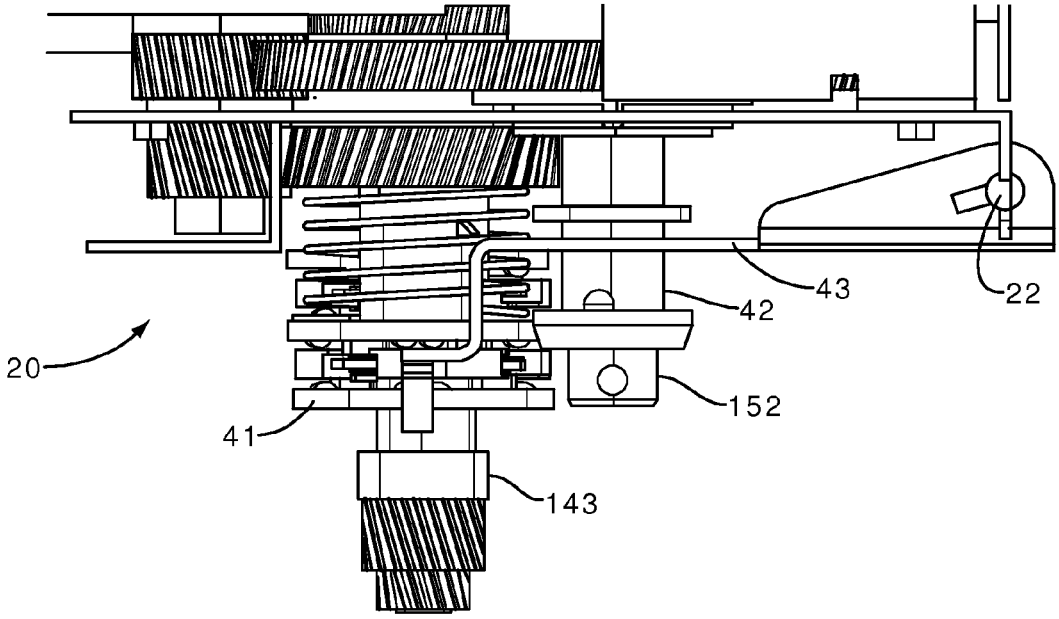
FIG. 8A is a top view of a retraction mechanism in an extended position according to one embodiment.
Figure 8B:
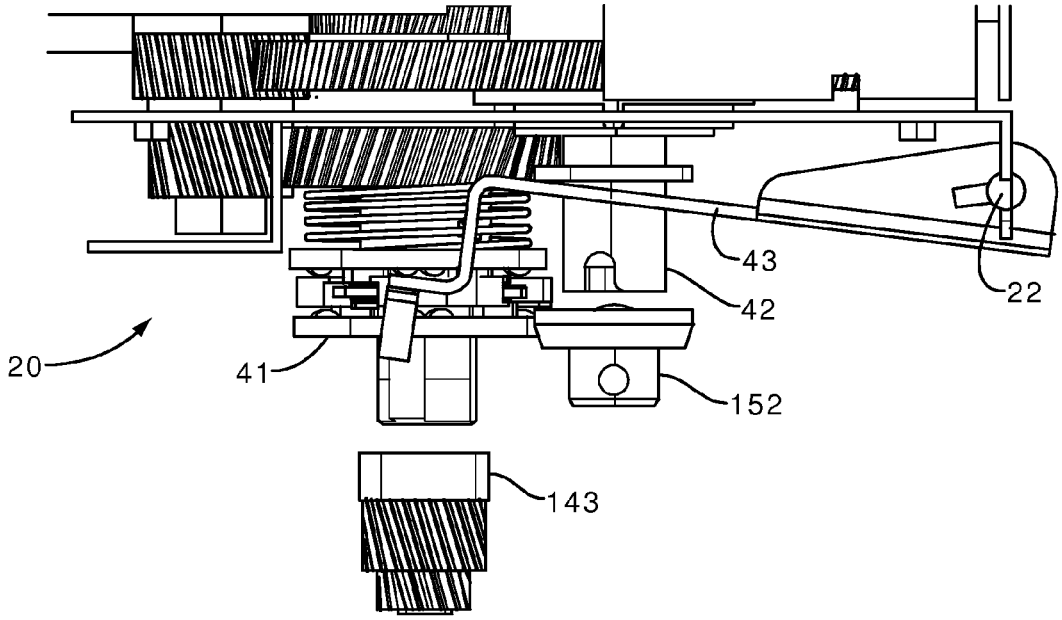
FIG. 8B is a top view of a retraction mechanism in a retracted position according to one embodiment.

FIGS. 8A and 8B depict the operation of the pivoting coupling retraction mechanism 20. In FIG. 8A, the mechanism 20 is in an engaged position, with the developer unit coupling 41 coupled to a developer unit drive receiver 143, which is affixed to the developer unit 141 (not shown). Additionally, the photoconductor unit coupling 42 is coupled to a photoconductor unit drive receiver 152, attached to a photoconductor unit 150 (not illustrated). Note that all (e.g., four) pairs of developer unit couplings 41 and photoconductor unit couplings 42 are simultaneously engaged.

FIG. 8B depicts the pivoting coupling retraction mechanism 20 in a retracted position, wherein the pivoting retraction plate 43 has rotated about the pivot rod 22. The pivoting retraction plate 43 retracts both the developer unit coupling 41 and the photoconductor unit coupling 42 laterally, in an axial direction, thus disengaging the couplings 41, 42 from the developer unit and photoconductor unit drive receivers 143, 152, respectively. With the couplings 41, 42 thus retracted, the first door assembly 110 holding the photoconductor units 150 may be opened (to facilitate the removal or installation of a photoconductor units 150), and the developer units 141 may be freely removed from, or inserted into, the body 101 of the image forming apparatus 100.

Figure 9:
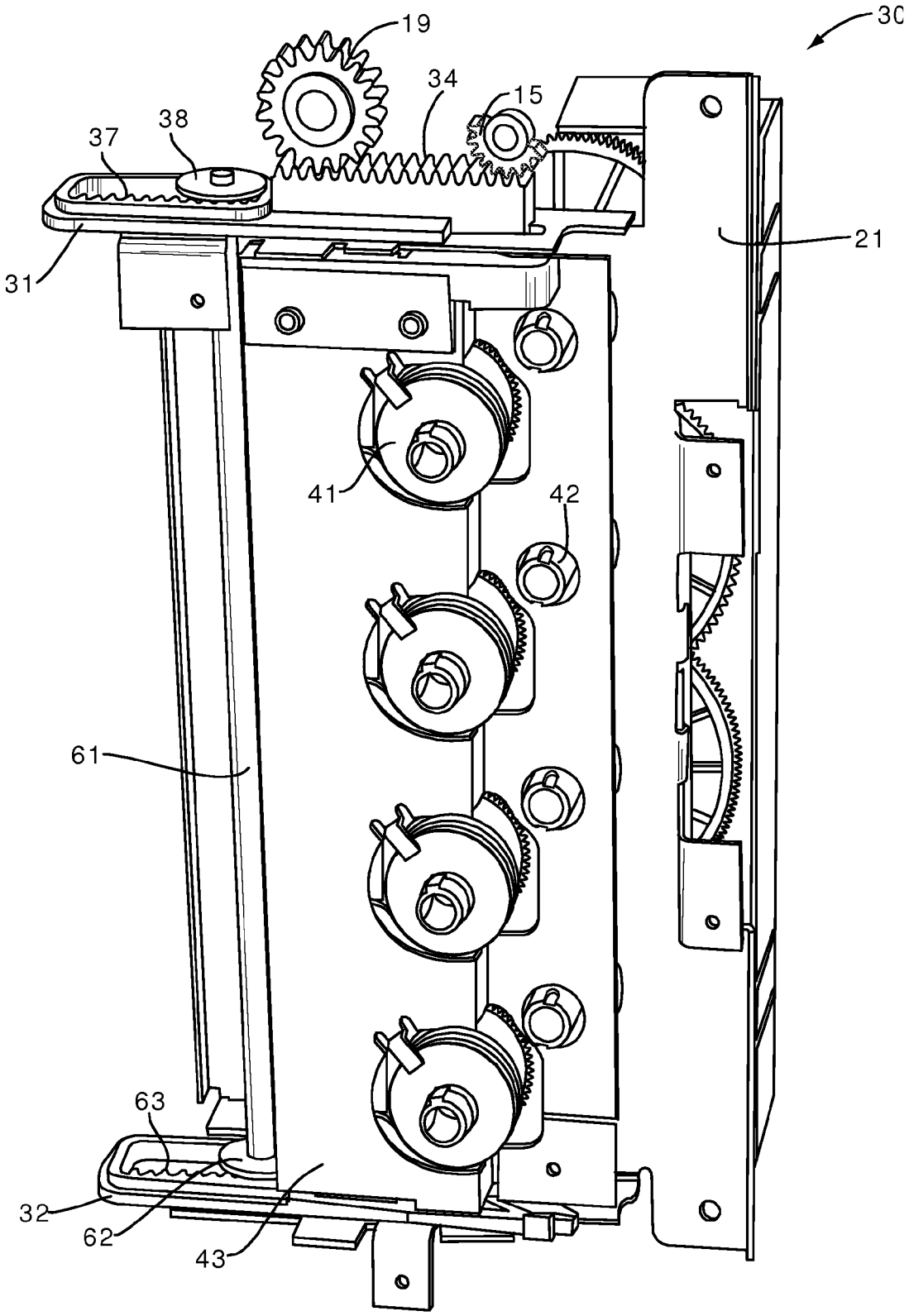
FIG. 9 is a perspective view of a retraction mechanism according to one embodiment.

In another embodiment of the present invention, the retraction plate 43 is operative to move the developer unit couplings 41 and the photoconductor unit couplings 42 between engaged and retracted positions by translating in the axial direction of the couplings. FIG. 9 depicts a translating coupling retraction mechanism according to the present invention, indicated generally by the numeral 30. Similar to the pivoting coupling retraction mechanism 20, the translating coupling retraction mechanism 30 includes a gearbox assembly 21, a translating retraction plate 43, and a plurality of pairs of developer unit couplings 41 and photoconductor unit couplings 42. In addition, the translating coupling retraction mechanism 30 includes an upper rack plate 31 and lower rack plate 32, as depicted in greater detail in FIGS. 10 and 11, respectively.

Figure 10:
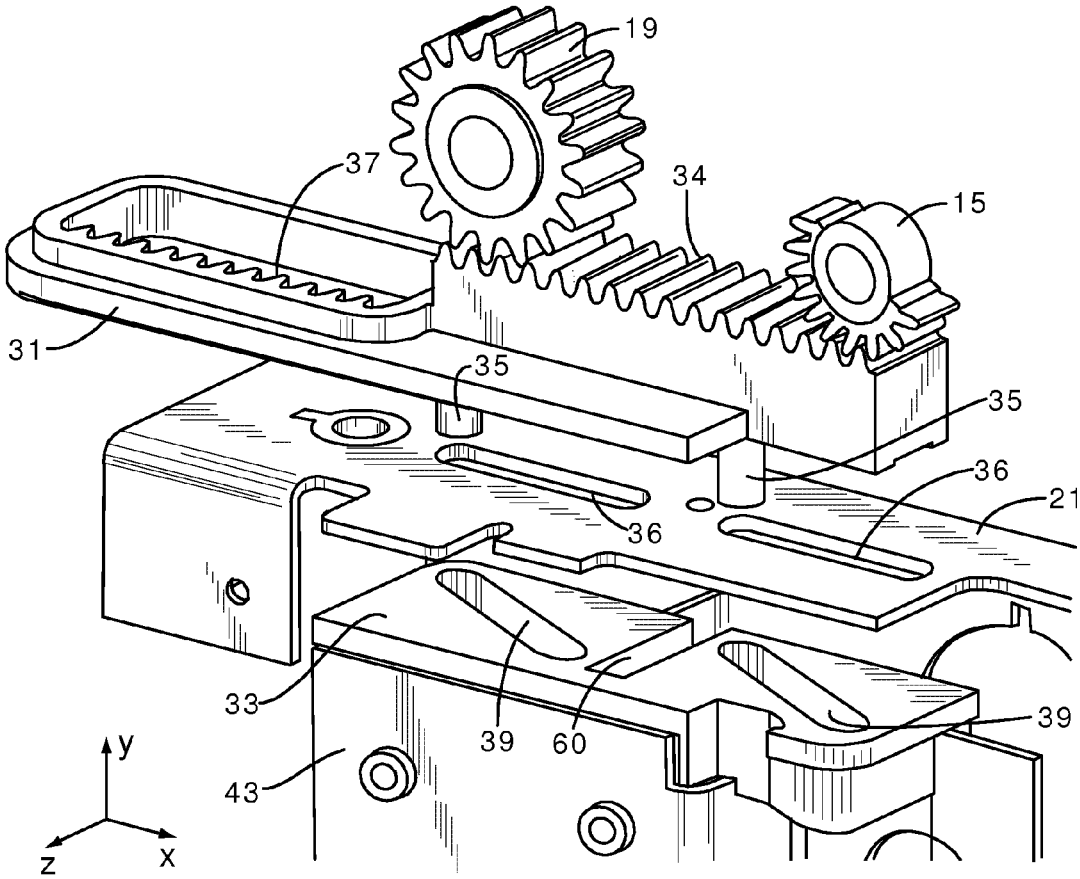
FIG. 10 is a partial perspective view of a retraction mechanism according to one embodiment.

FIG. 10 is an exploded perspective view of the translating coupling retraction mechanism 30, including the retraction plate 43, a retraction plate bracket 33 affixed to the retraction plate 43, the upper portion of the gear box assembly 21, an upper rack plate 31, and a drive gear 19.

The drive gear 19, preferably a spur gear as shown, is rotated in a counter-clockwise direction to retract the couplings 41, 42, such as when a command is entered by a user. The drive gear 19 meshes with a drive rack 34 (preferably a spur rack) to translate the rack plate 31 in the positive x-direction, or to the right as depicted in FIG. 10. The upper rack plate 31 is constrained to translation in the x-direction by the engagement of upper rack plate pins 35 in upper x-slots 36 formed in the gearbox frame 21. As the upper rack plate 31 is translated in the x-direction, an upper coordinating rack 37 turns an upper pinion 38 (see FIG. 9) in a counter-clockwise direction.

The upper rack plate pins 35 additionally engage in angled slots 39 formed in the retraction plate bracket 33. The angled slots 39 are disposed at an acute angle from the x-direction. As the upper rack plate 31 translates in the positive x-direction (to the right), the rack plate pins 35 exert a component of force on the angled slots 39 in the retraction plate bracket 33 in the negative z-direction, i.e., into the plane of the paper as depicted in FIG. 10. Since the retraction plate bracket 33 is affixed to the translating retraction plate 43, the translating retraction plate 43 is translated in the negative z-direction, i.e., in the axial direction of the couplings 41, 42. This translation retracts the couplings 41, 42 from the drive receivers 143, 152, similarly to the position depicted in FIG. 8B. In one embodiment, the translating retraction plate 43 is constrained to movement in the z-direction by a z-slot 60 formed in the retraction plate bracket 33 by a pin (not illustrated) that extends downward from the gearbox frame 21.

Referring to FIG. 9, as the upper rack plate 31 translates in the positive x-direction (to the right), the upper pinion 38 is rotated counter-clockwise. The upper pinion 38 is connected via a shaft 61 to the lower pinion 62. As the lower pinion 62 rotates counter-clockwise, it engages with a lower coordinating rack 63, formed in the lower rack plate 32, causing the lower rack plate 32 to translate in the positive x-direction (to the right as depicted in FIGS. 9 and 10), in coordination with the translation of the upper rack plate 31.

Figure 11:
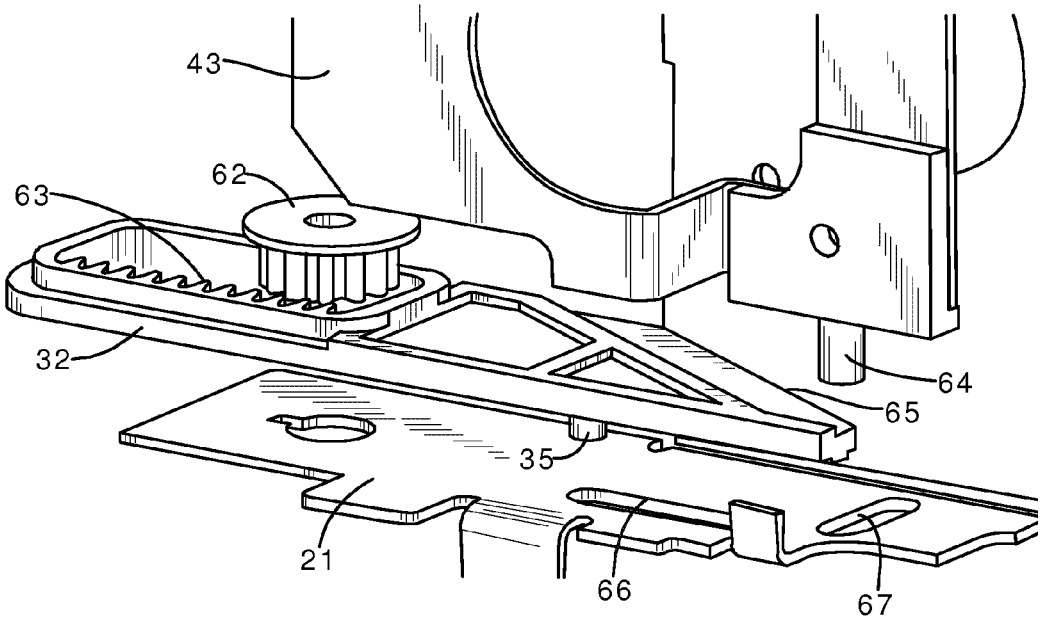
FIG. 11 is a partial perspective view of a retraction mechanism according to one embodiment.

Referring to FIG. 11, as the lower rack plate 32 translates in the positive x-direction (to the right), a pin 64 rigidly affixed to the translating retraction plate 43 is engaged by the sloped cam surface 65 of the lower rack plate 32. The angle of the sloped cam surface 65 with respect to the x-direction is preferably the same as that of the angled slots 39 formed in the retraction plate bracket 33 (see FIG. 10).

As the lower rack plate 32 translates in the positive x-direction (to the right), a force in the negative z-direction (i.e., into the plane of the page as depicted in FIG. 11) is exerted on the pin 64. Since the pin 64 is rigidly affixed to the translating retraction plate 43, the translating retraction plate 43 is translated in the negative z-direction, disengaging the drive couplings 41, 42 from their respective drive receivers 143, 152.

The lower rack plate 32 is constrained to motion in the x-direction by lower x-slot 66 formed in the lower gearbox frame 21. In addition to engaging the sloped cam surface 65, the pin 64 additionally engages a z-slot 67 formed in the lower gearbox frame 21. This constrains the motion of the translating retraction plate 43 to the z-direction. That is, the translating retraction plate 43 is constrained to motion in the axial direction of the drive couplings 41, 42.

Following installation or removal of developer units 141 and/or photoconductor units 150, the first door assembly 110 is closed. The drive gear 19 is rotated in the clockwise direction, which engages drive rack 34 and translates the upper rack plate 31 in the negative x-direction, or to the left as depicted in FIGS. 9-11. As the upper rack plate pins 35 (constrained to x-direction motion by x-slots 36) translate in the negative x-direction, they engage angled slots 39, moving the translating retraction plate 43 in the positive z-direction to engage couplings 41, 42 with drive receivers 143, 152.

Simultaneously, the upper coordinating rack 37 drives the upper pinion 38 and, via shaft 61, the lower pinion 62 in a clockwise direction. The lower pinion 62 engages lower coordinating rack 63 to translate the lower rack plate 32 in the negative x-direction. As the sloped cam surface 65 of the lower rack plate 32 translates in the negative x-direction, it allows the pin 64, and consequently the translating retraction plate 43, to translate in the positive z-direction, thereby engaging couplings 41, 42 with drive receivers 143, 152. Note that in this embodiment, the translating retraction plate 43 is biased to the positive z-direction, such as by one or more biasing members. Alternatively, the lower end of the translating retraction plate 43 may be actively forced to translate in the positive z-direction by the use of an angled slot (similar to angled slots 39 formed in the retraction plate bracket 33 as depicted in FIG. 10) in the lower rack plate 32, in lieu of the sloped cam surface 65. Such a straightforward modification would be readily apparent to one of ordinary skill in the art and would fall within the scope of the present invention.

Embodiments of retraction mechanisms are disclosed in U.S. Pat. No. 7,130,562, herein incorporated by reference.

Figure 13:
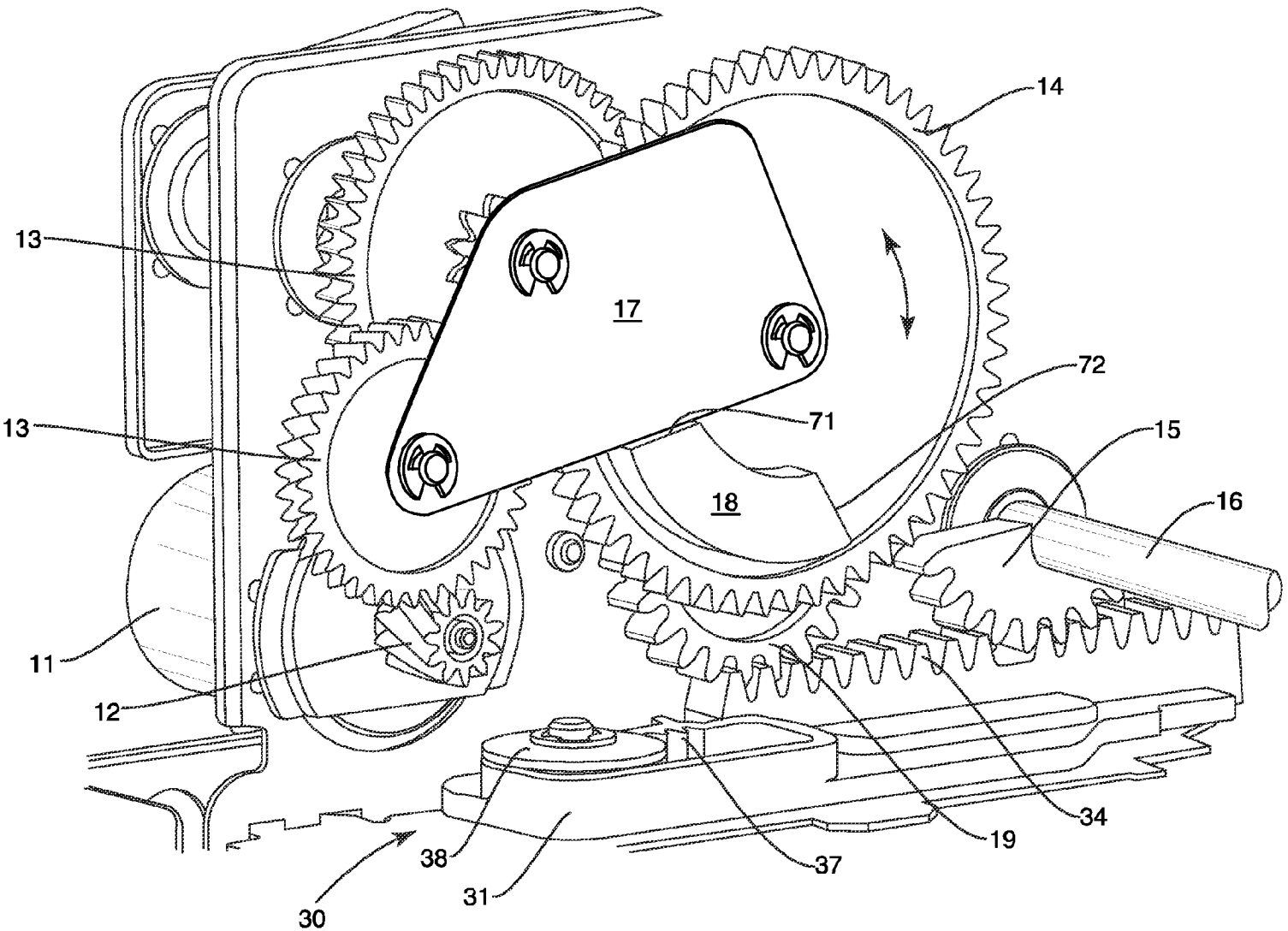
FIG. 13 is a perspective view of a motor arrangement according to one embodiment.

FIGS. 12 and 13 illustrate an embodiment of the motor arrangement 10. These Figures include an embodiment with the second retraction assembly 30. FIG. 12 includes the imaging units 140 removed from the image forming device for clarity. The motor arrangement 10 provides for moving the one or more latches 50 between the locked and unlocked positions, and moving the retraction assembly 30 between extended and retracted positions.

The motor arrangement 10 includes a motor 11 with an input gear 12 as illustrated in FIGS. 12 and 13. A plurality of gears 13 are operatively connected to the input gear 12 for controlling movement of the retraction assembly 30 and latches 50. A first gear path leads from the input gear 12 to the drive gear 19 that engages with the drive rack 34 for moving the retraction plate 43 as previously discussed. A second gear path leads from the input gear 12 to a latch gear 15 that controls movement of the one or more latches 50. In one embodiment as illustrated in FIG. 12, a shaft 16 is operatively connected to the latch gear 15 to provide power to a second latch gear 15 on the opposite side of the first door assembly 110. In this embodiment, the first door assembly 110 is locked by two motorized latches 50 on the upper sections, and two biased latches (not illustrated) on the lower section.

Figure 14:
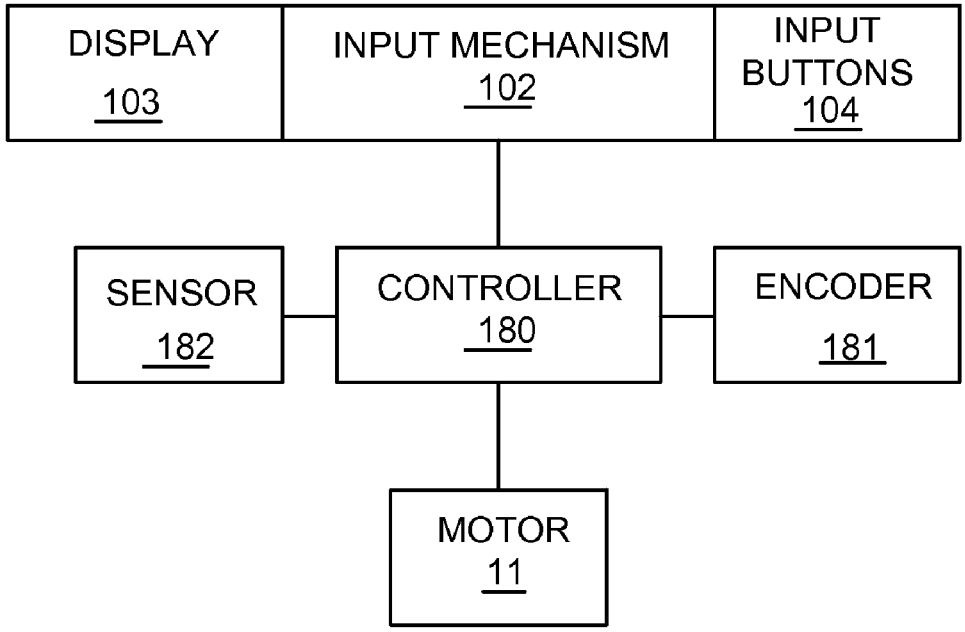
FIG. 14 is a schematic view of a controller according to one embodiment.

The controller 180 may oversee the operation of the motor arrangement 10 to control the position of the latch 50 and retraction assembly 40. FIG. 14 illustrates schematically one embodiment of the controller 180 that is operatively connected to the motor 11. Further, the controller 180 may receive input commands from the user through the input mechanism 102 to control the operations of the image forming device 100, including access to the interior 105. In one embodiment, controller 180 includes a microcontroller with associated memory. In one embodiment, controller 40 includes a microprocessor, random access memory, and read only memory.

Various embodiments may be included for the controller 180 to monitor the motor arrangement and thus the position of the latches 50 and retraction assembly 40. FIGS. 12 and 13 illustrate one embodiment of the motor arrangement 10 that includes an enlarged control gear 14 with a stop feature 18 mounted on one side. In the embodiment of FIGS. 12 and 13, the stop feature 18 includes a block that extends outward from a face of the control gear 14 and includes a first end 71 and a second end 72. A plate 17 is mounted adjacent to the control gear 14 to be contacted by the stop feature 18. In one embodiment, the plate 17 partially overlaps the control gear 14. The plate 17 may include a first straight surface and a second straight surface. The first straight surface positioned at an angle to the second straight surface.

During use, the control gear 14 is positioned with the second end 72 of the stop feature 18 against the stop plate 17. The diameter of the control gear 14 is such that this corresponds to the latches 50 being in one of the locked or unlocked positions, and the retraction assembly 30 being in one of the extended or retracted positions. In the embodiment of FIGS. 12 and 13, this position places the latches 50 in the unlocked position and the retraction assembly 30 in the retracted position. The motor arrangement 10 may then be activated for the motor 11 to drive the control gear 14 to a second position with the first end 71 of the stop feature 18 contacting against the stop plate 17. This corresponds to the latches 50 being in the opposite position as when the second end 72 is in contact with the stop plate 17. In the embodiment of FIGS. 12 and 13, the first end 71 in contact with the stop plate 17 places the latches 50 in the unlocked position and the retraction assembly 30 in the retracted position.

The control gear 14 includes an enlarged diameter such that it rotates less than about one full revolution (i.e., less than 360°) between the first and second positions. In one specific embodiment, the control gear 14 rotates less than about 270° between positions. The control gear 14 may include a larger diameter than any of the other gears 13.

In one embodiment, the controller 180 monitors a pulse width modulation (pwm) value of the motor 11. A range of pwm values occur when the motor 11 is activated and rotating the control gear 14 between positions. Controller 180 determines that the control gear 14 is at one of the positions when the pwm value reaches a predetermined elevated value. This value occurs as the stop feature 18 contacts the plate 17 and prevents further rotation of the control gear 14 thus causing strain on the motor 11. Upon reaching the pwm value, the controller 180 deactivates the motor 11 and waits for a subsequent signal to reverse. Using this system of determining the position of the control gear 14, and thus positions of the retraction assembly 40 and latches 50, saves the costs of adding an additional sensor that would otherwise be required to detect the travel of the control gear 14.

In another embodiment, the controller 180 monitors the motor arrangement 10 through an encoder 181 (see FIG. 14). The encoder ascertains the number of revolutions and rotational position of the motor 11. From this information, the controller 180 is able to determine the angular position of the latch 50 and the position of the retraction assembly 40. Various types of motors may be used with the encoder 181, including but not limited to brushed DC motors and brushless DC motors.

In other embodiments, the motor arrangement 10 does not include a control gear 14. Other elements within the motor arrangement 10, latch assemblies, and/or retraction assembly 40 contact together to create a noticeable change in the pwm value of the motor 11. In one embodiment, the pwm value is elevated due to contact between the gearbox frame 21 in the Z-slot 60 attached to the retraction plate 43. Other embodiments may include pins 35 within slots 36 and/or slots 39, and a stop on the shaft 16.

Another embodiment includes one or more sensors 182 operatively connected to the controller 180 to sense the position of one or more of the motor arrangement 10, latch assemblies, or retraction assembly 40. In one embodiment, the sensor 182 is an optical sensor that detects the position of an element. In one embodiment, a sensor 182 is positioned to detect the location of the retraction plate 43, such as at an extended position or a retracted position. The controller 180 may receive this information and monitor the on-going position of the motor arrangement 10, latch assembly, and retraction assembly 40 based on the information in combination with information from the encoder 181. In another embodiment, a sensor 182 is positioned on the upper rack plate 31 or lower rack plate 32. The controller 180 is able to use this information to monitor the on-going locations of the various elements.

One advantage of this configuration is the motor 11 may be deactivated when the latches 50 are in the locked position to prevent access to the interior 105. Therefore, the image forming device 100 may be turned off when not in use and prevent access to the interior 105 and any possible theft of the image forming units 140.

In one embodiment, movement of the motor arrangement 10 is controlled through user inputs. FIG. 14 illustrates the controller 180 configured to receive commands from the user through the input buttons 104 on the control panel 102. Controller 180 is also able to output messages on the display 103 to prompt a user to input commands or confirm receipt of commands.

In one embodiment, the controller 180 maintains the latches 50 in the locked position and the retraction assembly 20, 30 in the extended position. These positions provide for image formation to occur. The user may enter a command through the input buttons 104 on the control panel 102 to move the latches 50 to the unlocked position and retract the retraction assembly 20, 30. In these positions, the user is able to move the first door assembly 110 to the open position and access the interior 105 and perform any necessary steps. Once complete, the user returns the first door assembly 110 to the closed position. In one embodiment, the controller 180 automatically activates the motor 11 and returns the latches 50 to the locked position and the retraction assembly 30 to the extended position. In another embodiment, the user enters a command for the controller 180 to perform these operations. When the image forming device 100 is powered off, the motor 11 is locked in this position to prevent access to the interior 105.

In one embodiment, the motor arrangement 10 operates both the latch 50 and retraction assembly 40. In other embodiments, the motor arrangement 10 operates one of the latch 50 and retraction assembly 40.

In one embodiment, the controller 180 controls the latch 50 and the locking and unlocking of the door assembly 110. The controller 180 moves the latch 50 to the locked position during the image formation process. Once the process is complete, the controller 180 moves the latch 50 to the unlocked position. This prevents a user from inadvertently opening the door assembly 110 during the image formation process and causing either a media jam, or mis-print. In one embodiment, there is no user interface 102.

In one embodiment, the latch 50 is moved by one or more solenoids 190, shown in dashed lines in FIG. 1. The controller 180 activates the solenoid 190 to move the latch 50 between the locked and unlocked positions.

Spatially relative terms such as "under", "below", "lower", "over", "upper", and the like, are used for ease of description to explain the positioning of one element relative to a second element. These terms are intended to encompass different positions of the device in addition to different positions than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A system to control access to an interior of an image forming device comprising:

a body with an interior space configured to contain an image forming unit, the image forming unit including a developer unit and a photoconductive unit;

a door connected to the body and movable between an open position to provide access to the interior space and a closed position to prevent access to the interior space;

a latch connected to the body and movable between a locked position to engage with and lock the door in the closed position and an unlocked position disengaged from the door to allow the door to move to the open position;

a controller positioned within the body to control the movement of the latch between the locked and unlocked positions, the controller configured to receive commands from a user and control the movement of the latch in accordance with the commands; and a retraction assembly positioned within the body, the retraction assembly movable between an extended position to engage with the developer unit and the photoconductive unit of the image forming unit and a retracted position to disengage from the developer unit and the photoconductive unit of the image forming unit, the retraction assembly operatively connected to the controller, wherein the retraction assembly is operatively connected to the latch with movement of the latch between the locked and unlocked positions resulting in movement of the retraction assembly between the extended and retracted positions.

2. The system of claim 1, further comprising a user interface positioned on the body and including at least one input mechanism to receive the commands from the user.

3. The system of claim 1, further comprising a motor arrangement positioned within the body and operatively connected to the latch to control the movement of the latch between the locked and unlocked positions, the motor arrangement including a motor and a plurality of gears that rotate in a first direction to move the latch from the locked position to the unlocked position, and rotate in a second direction to move the latch from the unlocked position to the locked position.

4. The system of claim 1, further comprising a motor arrangement that includes a control gear with a stop feature that extends outward from a face of the control gear and a stop member positioned in proximity to the control gear, the control gear adapted to limit the motor arrangement from driving the latch in a first direction beyond the locked position due to contact between a first section of the stop feature and a first section of the stop member, the control gear further adapted to limit the motor from driving the latch in a second direction beyond the unlocked position due to contact between a second section of the stop feature and a second section of the stop member.

5. The system of claim 4, wherein the stop member includes a plate mounted over the face of the control gear, the plate including a first section that is contacted by the first edge of the stop feature and a second section spaced away from the first section that is contacted by the second edge of the stop feature.

6. The motor arrangement of claim 3, further comprising a solenoid operatively connected to the controller, the solenoid adapted to move the latch between the locked and unlocked positions.

7. A system to control access to an interior of an image forming device comprising:

a body with an interior space configured to contain an image forming unit, the image forming unit including a developer unit and a photoconductive unit;

a door connected to the body and movable between an open position to provide access to the interior space and a closed position to prevent access to the interior space;

a latch connected to the body and movable between a locked position to engage with and lock the door in the closed position and an unlocked position disengaged from the door to allow the door to move to the open position;

a motor arrangement positioned within the body and including a motor and a plurality of gears that are operatively connected to the latch, the motor arrangement adapted to operate in a first direction to move the latch to the locked position and operate in a second direction to move the latch to the unlocked position;

a controller positioned within the body to control the motor arrangement;

a retraction assembly positioned within the body and including a coupling, the retraction assembly movable by the motor arrangement between a first position with the coupling engaged with the image forming unit and a second position with the coupling disengaged with the image forming unit; and a user interface positioned on an exterior of the body and configured to receive commands from a user that are forwarded to the controller to control movement of the latch;

wherein the retraction assembly is operatively connected to the latch with movement of the latch between the locked and unlocked positions resulting in movement of the retraction assembly between the first and second positions.

8. The system of claim 7, wherein the motor arrangement includes a control gear operatively connected to the motor through the plurality of gears, the control gear including a stop feature that includes a first contact surface and a second contact surface, the motor arrangement further including a stop member positioned in proximity to the control gear, the control gear adapted to stop the plurality of gears at a first position when the motor operates in a first direction by contacting the first contact surface of the stop feature against the stop member, and adapted to stop the plurality of gears at a second position when the motor operates in a second direction by contacting the second contact surface of the stop feature against the stop member, in the first position, the plurality of gears adapted to position the latch in the locked position to lock the door, and in the second position the plurality of gears adapted to position the latch in the unlocked position to unlock the door.

9. The system of claim 8, wherein the motor arrangement further includes an encoder operatively connected to the controller to determine a position of the motor.

10. The system of claim 7, further including a sensor positioned within the body to detect the position of the latch, the sensor operatively connected to the controller.

11. The system of claim 7, wherein the latch includes first and second opposing arms that are separated by an opening that is sized to receive a frame of the door.

12. The system of claim 7, further including a sensor positioned within the body to detect a position of an internal element within the body, the sensor operatively connected to the controller.

13. The system of claim 1, wherein the retraction assembly comprises a gearbox frame housing a plurality of drive components and a pivoting retraction plate.

14. The system of claim 13, wherein the pivoting retraction plate simultaneously moves the plurality of drive components from the extended position to the retracted position upon movement of the door away from the body.

15. The system of claim 13, wherein the pivoting retraction plate simultaneously moves the plurality of drive components from the retracted position to the extended position upon movement of the door closer to the body.

16. The system of claim 13, wherein the plurality of drive components includes a developer unit coupling and a photoconductor unit coupling.

* * * * *